US005983606A

United States Patent [19]

Hannen et al.

[11] Patent Number: 5,983,606

[45] Date of Patent: Nov. 16, 1999

[54] DEVICE AND METHOD FOR PACKAGING A WEB ROLL WITH A PACKAGING SHEET

[75] Inventors: Jakob Hannen, Willich, Germany; Jozef-Franc Zajec, Velden, Netherlands; Volker Schölzke, Krefeld, Germany; Frank Rostek, Meerbusch, Germany; Hans-Josef Peters, Kleve, Germany; Udo Ticheloven, Wesel, Germany

[73] Assignee: Voith Sulzer Finishing GmbH, Krefeld, Germany

[21] Appl. No.: 08/991,797

[22] Filed: Dec. 16, 1997

[30] Foreign Application Priority Data

Dec. 17, 1996 [DE] Germany ..... 196 52 448

[51] Int. Cl.[6] ..... B65B 11/04

[52] U.S. Cl. ..... 53/465; 53/211; 53/587

[58] Field of Search ..... 53/211, 214, 587, 53/215, 399, 465, 389.2, 389.4

[56] References Cited

U.S. PATENT DOCUMENTS

| | | | |
|---|---|---|---|
| 1,351,809 | 9/1920 | Sutherland | 53/211 X |
| 3,191,289 | 6/1965 | Fleischer | 53/211 X |
| 3,863,425 | 2/1975 | Edwards et al. . | |
| 3,928,939 | 12/1975 | Edwards et al. . | |
| 4,222,533 | 9/1980 | Pongracz . | |
| 4,341,586 | 7/1982 | Kuotonen . | |
| 4,736,567 | 4/1988 | Pienta | 53/214 X |
| 4,882,892 | 11/1989 | Pienta | 53/214 X |
| 5,071,501 | 12/1991 | Doi et al. . | |
| 5,768,858 | 6/1998 | Hannen . | |

FOREIGN PATENT DOCUMENTS

| | | |
|---|---|---|
| 9004 | 3/1980 | European Pat. Off. . |
| 431922 | 6/1991 | European Pat. Off. . |
| 19535746 | 4/1997 | Germany . |
| 886435 | 1/1962 | United Kingdom . |
| 1283458 | 7/1972 | United Kingdom . |
| 1429445 | 3/1976 | United Kingdom . |

*Primary Examiner*—Linda Johnson
*Attorney, Agent, or Firm*—Greenblum & Bernstein, P.L.C.

[57] ABSTRACT

A device and method for packaging a web roll with a packaging sheet dispenser that dispenses a packaging sheet at an adjustable angle relative to the radial direction of the web roll, that can be moved parallel to the axial direction of the web roll, and on which a supply roll of the packaging sheet is provided, along with a motor-drive for the web roll to be packaged.

26 Claims, 4 Drawing Sheets

5
33
26
22
25
9
27
29
10
23
28
21
24
4
3
20
17
18
19
16
15
13
14

DEVICE AND METHOD FOR PACKAGING A WEB ROLL WITH A PACKAGING SHEET

CROSS-REFERENCE TO RELATED APPLICATION

The present invention claims the priority under 35 U.S.C. § 119 of German Application No. 196 52 448.2 filed Dec. 17, 1996, the disclosure of which is expressly incorporated by reference herein in its entirety.

BACKGROUND INFORMATION

1. Field of the Invention

The present invention relates to a device and method for packaging a web roll with a packaging sheet dispenser that dispenses a packaging sheet at an adjustable angle relative to the radial direction of the web roll, that can be moved parallel to the axial direction of the web roll, and on which a supply roll of the packaging sheet is provided, along with a motor-drive for the web roll to be packaged.

2. Discussion of Background Information

A web packaging device is disclosed in GB 1 429 445. As shown in this reference, a web roll, for example a paper roll, is wrapped with a plastic sheet. The plastic sheet has a substantially smaller width than the web roll being packaged. During the packaging process, the plastic sheet is first aligned to the circumferential direction of the web roll and secured thereon. The web roll is then rotated, resulting in the formation of an edge- or end-packaging. After a predetermined number of rotations of the web roll, the packaging sheet dispenser is then turned, such that the width direction of the packaging sheet leaves its orientation parallel to the web roll being packaged and forms an acute angle therewith. When the web roll rotates further, the packaging sheet dispenser simultaneously moves parallel to the axis of the web roll, resulting in helical packaging.

A similar principle is shown in publication DE 195 35 746 A1. Packing paper, whose specific weight is somewhat higher than that of a plastic sheet, is the packaging material used therein.

The advantage to this type of helical packaging lies in the fact that with a single width of packaging sheet, a multitude of web rolls can be wrapped, regardless of their widths. It is not necessary to stock packaging sheets in varying widths. Helical packaging thus simplifies the inventory of packaging sheet material, thereby increasing the economy of roll packaging.

A disadvantage, however, is that it is not sufficient to merely rotate the web roll a number of times corresponding to the amount of packaging sheet layers desired, for example two or three times. A multitude of rotations are necessary before the web roll is enveloped along its entire length. This requires increased packaging time. Moreover, the possibility for increasing packaging speed is limited. Especially when using packing paper, there is considerable danger of the packaging sheet tearing if wrapping velocity is increased too much within a short period of time. Increased wrapping velocity, however, is necessary for attaining higher packaging speeds.

SUMMARY OF THE INVENTION

To keep packaging times brief, the present invention provides a device and method for packaging a web roll with a packaging sheet dispenser that dispenses a packaging sheet at an adjustable angle relative to a radial direction of the web roll, that can be moved parallel to an axial direction of the web roll, and on which a supply roll of packaging sheet and a controllable rotational motor drive is provided, along with a motor drive for the web roll to be packaged.

According to the present invention, packaging times, that is, the speed with which the packaging sheet is placed on the web roll being wrapped, can be increased substantially. Experiments have shown that web speeds of 300 m/min can be attained without difficulty. Further, such web speeds can be reached after a very short acceleration time period, due to the motor-drive of the supply roll. Moreover, high packaging speeds can be maintained over a large part of the axial length of a web roll.

The controllable rotational motor-drive sets the supply roll in motion at the beginning of the wrapping process and brakes it at the end. At the beginning of the wrapping process, this eliminates the need for the supply roll of the packaging sheet to accelerate rotationally based merely on the draw of the packaging sheet. Instead, according to the present invention, the packaging sheet is provided by the supply roll in the amount needed for wrapping the web roll. The rotational motor-drive compensates for the substantial moment of inertia of the packaging sheet supply roll. In reverse, the rotational motor-drive brakes the supply roll at the end of the wrapping process, such that no appreciable amount of excess packaging sheet is created. Accordingly, braking times can be kept brief.

A preferred embodiment of the present invention includes a packaging sheet dispenser having a packaging feed device with at least one-motor driven packaging feed roll. According to this embodiment, the velocity of the packaging sheet can be better adjusted in relation to the circumferential velocity of the web roll being packaged, as the packaging feed roll cooperates with a mating roll. The speed of the packaging sheet is determined by the roll opening thus formed. Hence, the demands on the accuracy of the rotational motor-drive can thereby be decreased. It is no longer necessary for the packaging sheet to be delivered by the supply roll at exactly the speed with which it is dispensed to the web roll, because small fluctuations can be compensated for by the packaging feed roll. This can also ensure that a certain tension is maintained between the web roll and the packaging feed device, so that a very taut packaging of the web roll is achieved.

According to another aspect of the present invention, a separating device is provided which is arranged between the web roll and the packaging feed device. Upon completion of the wrapping process the web can thus be severed. The packaging sheet remains, however, in the packaging feed device so that it can still be motor-driven. That is, it can still be fed to the web roll being packaged without additional measures being taken, should this be necessary for a further step in the wrapping process. Conversely, the packaging sheet can be fed if a new web roll needs to be packaged. The separating device can be designed, for example, as a severing knife. Further, the packaging feed device can be designed to create somewhat greater web tension at the moment of separation, such that the packaging sheet is stretched more tautly before the severing knife is lowered, than during the wrapping process.

According to yet another aspect of the present invention, a glue enabling device is arranged between the web roll and the separating device. The glue enabling device may include a glue application device. If a packaging sheet to which glue has previously been applied is used, for example a water-soluble cold glue, then the glue enabling device could consist simply of a moistening or water application device.

On the other hand, if a heat-activated adhesive has been applied to the packaging sheet, a heating device could function as the glue enabling device. Because the glue enabling device is positioned between the web roll and the separating device, it is ensured that the packaging sheet can always be provided with glue up to its very end. It is further ensured that the separating device remains clean, in that it does not come in contact with glue. The packaging feed device and the glue enabling device are arranged on a packaging sheet dispenser, together on a sled. The sled can be moved parallel to the axial direction of the web roll being packaged. Thus, distances and reaction times can be kept very short.

According to another aspect of the present invention, a rotational motor-drive is provided along the axis or axle of the supply roll. Very sensitive rotational control of the supply roll can thus be achieved. The packaging sheet is protected to a greater extent than it would be, for example, where carrier rolls are used for the packaging sheet. The rotational motor-drive can act directly upon the packaging sheet roll without having to take slippage or friction into account.

It is particularly preferred that a control device be provided to coordinate the circumferential speed of the supply roll with that of the web roll. In the simplest case, a diameter sensor is provided which determines the diameter of the packaging roll. As a general rule, the circumferential speed of the web roll is known because the web roll lies on carrier rolls, at least one of which is motor-driven. It also is known that as the diameter of the packaging sheet roll decreases, its number of rotations must be increased, in order to coordinate the discharge speed of the supply roll with the circumferential speed of the web roll. However, such coordination does not require that the circumferential speed of the web roll be in exact agreement with that of the supply roll. In the case of the supply roll, its circumferential speed is determined in part by the axial displacement of the packaging sheet dispenser.

According to another aspect of the present invention, the packaging sheet dispenser includes a guide surface on which the packaging sheet glides to a carrier roll on which the web roll is located. It is preferred if the packaging sheet dispenser is arranged alongside the web roll. This simplifies loading the packaging sheet dispenser with the supply roll, as the supply roll need not be lifted particularly high. However, in such an arrangement, it is not easy to bring the packaging sheet to the web roll or to secure it thereon. If a guide surface is provided, however, this problem is solved by relatively simple means. The packaging sheet has a certain inherent stiffness. If it is now advanced on the guide surface, for example by the packaging feed device, it reaches the carrier roll upon which the web roll is located. It is next fed between the web roll and the carrier roll and is then further advanced by the combined forces of the web roll and the carrier roll. Since glue has been applied to the packaging sheet, it adheres to the web roll, resulting in packaging of the web roll as it is rotated. Further, because the guide surface facilitates feeding the packaging sheet between the web roll and the carrier roll, "threading assistance" is not necessary.

It is particularly preferred for the guide surface to include multiple parts, such that at least one part of the guide surface adjacent to the carrier roll can be removed or retracted. The closer the guide surface is to the carrier roll, the easier it is to guide the packaging sheet. At the same time, however, the guide sheet can hinder the subsequent wrapping process, in particular at high speeds where vibrations cannot be prevented. If the "front" part of the guide surface can be pulled out, the distance between the guide surface and the carrier roll, and therefore the web roll, is increased. This can easily be done, since during the actual packaging process it is not necessary to guide the packaging sheet on the guide surface.

It is preferred that the end of the guide surface adjacent to the carrier roll extend at an arching gradient. Since the packaging sheet dispenser must be aligned at variously angled positions to the web roll, and therefore to the carrier roll, designing the front of the guide surface with an arching gradient allows the opening between the guide surface and the carrier roll to remain constant in practically all permitted angled positions. Therefore, it is ensured that the packaging sheet will be threaded between the web roll and the carrier roll with the necessary degree of reliability.

The present invention provides a device for packaging a web roll with a packaging sheet that includes a packaging sheet dispenser which dispenses the packaging sheet at an adjustable angle relative to the radial direction of the web roll where the packaging sheet dispenser is moveable parallel to the axial direction of the web roll, a supply roll of the packaging sheet arranged on the packaging dispenser, a controllable rotational motor-drive for the supply roll, and a motor-drive for the web roll being packaged. The packaging sheet dispenser may include a packaging feed device with at least one motor-driven packaging feed roll. Further, the web roll packaging device may include a separating device arranged between the web roll and the packaging feed device, and it may include a glue relaying device arranged between the web roll and the separating device.

Moreover, the supply roll rotational motor-drive may act upon the axis of the supply roll. A control device also may be included which coordinates the circumferential speed of the supply roll to the circumferential speed of the web roll. Additionally, the packaging sheet dispenser may include a guide surface on which the packaging sheet glides to a carrier roll of the web roll. This guide surface may include a plurality of parts, at least one of which is adjacent to the carrier roll and can be pulled in and out. Further, the guide surface may include an end adjacent to the carrier roll that extends at an arching gradient.

The present invention also provides a packaging sheet dispenser for packaging a web roll that includes a carriage, a motor-drive mounted on the carriage, a mounting bolt pivotally connecting the carriage with a moving device that moves the packaging sheet dispenser parallel to an axial direction of the web roll, a supply roll, an angle connection connecting the supply roll and the carriage, and a controllable rotational motor-drive rotatably connected with the supply roll. A rotational motor drive may drive an axle of the packaging sheet dispenser. The packaging sheet dispenser may also include a control device to coordinate the circumferential speeds of the supply roll and the web roll.

The packaging sheet dispenser may include a packaging feed device with a motor-driven packaging feed roll. Further, an adhesive application device may be positioned between the web roll and the separating device. The packaging sheet dispenser may include a guide surface on which the packaging sheet glides to a carrier roll of the web roll. This guide surface may have a plurality of parts, at least one guide surface part being adjacent to the carrier roll to be retracted and extended. Further, the guide surface may have an end adjacent to the carrier roll having an arching projection.

The present invention also encompasses a method for packaging a web roll with a packaging sheet dispenser which dispenses a packaging sheet at an adjustable angle to the radial direction of the web roll, where the packaging sheet dispenser being moveable parallel to the axial direction of the web roll, and where the packaging sheet dispenser includes a packaging sheet supply roll, a controllable rotational motor-drive being rotatably connected to an axle of the supply roll and a web roll motor-drive, and the method includes turning the packaging sheet dispenser to form an acute angle with the axis of the web roll, aligning the packaging sheet to the circumferential direction of the web roll, securing the packaging sheet to the web roll, rotating the web roll, and moving the packaging sheet dispenser parallel to the axis of the web roll to helically wrap a portion of the web roll. This method may also include severing the packaging sheet between the packaging sheet supply roll and the packaged web roll. Moreover, the method may include applying adhesive to a face of the packaging sheet. The circumferential speeds of the supply roll and the web roll may be coordinated with a control device. Further, the method may involve guiding the packaging sheet to a carrier roll of the web roll on a guide surface.

It goes without saying that the aforementioned and following characteristic features can be used not only in the described combinations, but also in other combinations or alone, without leaving the scope of the invention. Further embodiments and advantages can be seen from the detailed description and the accompanying figures.

BRIEF DESCRIPTION OF THE DRAWINGS

The present invention is further described in the detailed description which follows, in reference to the noted drawing by way of non-limiting examples of preferred embodiments of the present invention, wherein same reference numerals represent similar parts throughout the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, P16091.S02 the description taken with the drawings making apparent to those skilled in the art how the several forms of the invention may be embodied in practice.

Figure 1:
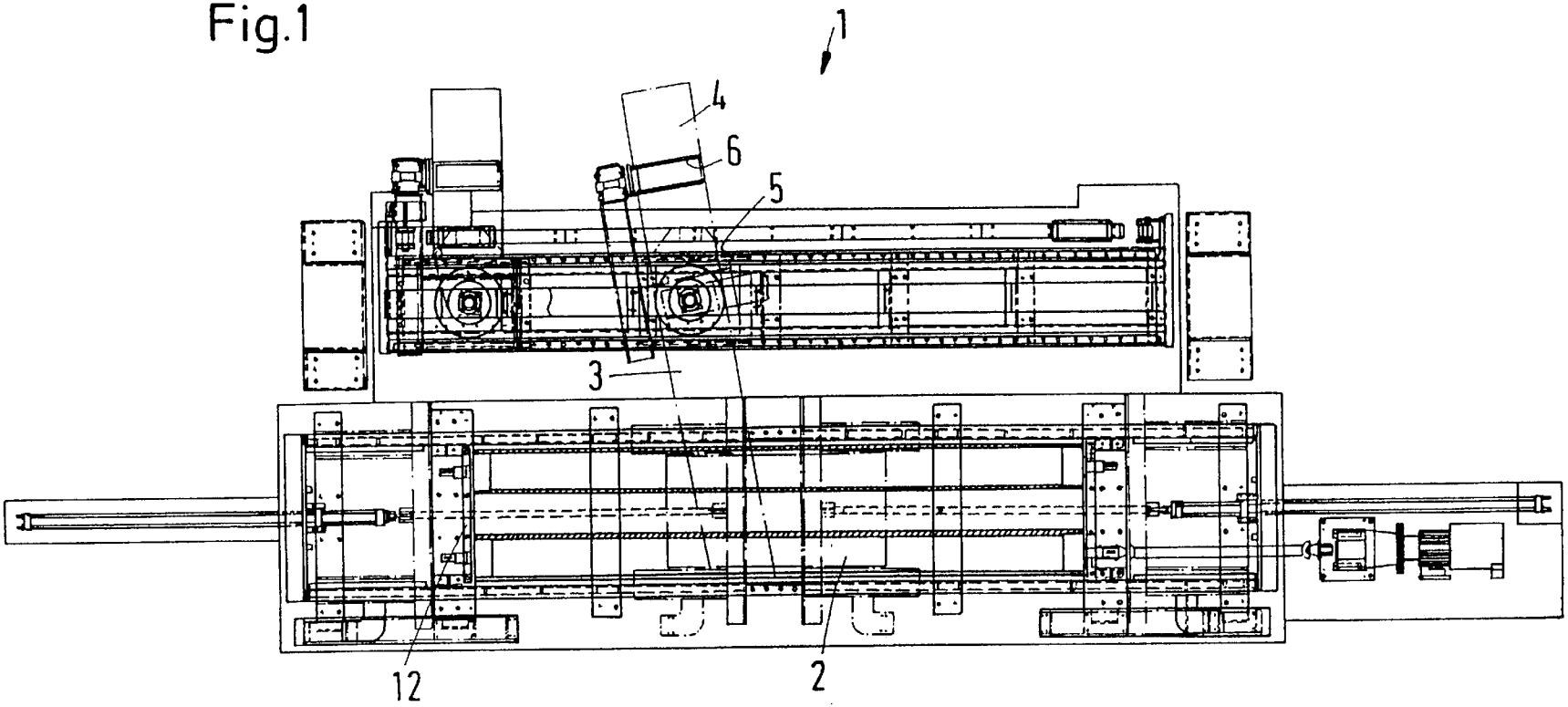
FIG. 1 shows a schematic top view of a packaging device according to one aspect of the present invention.
Figure 2:
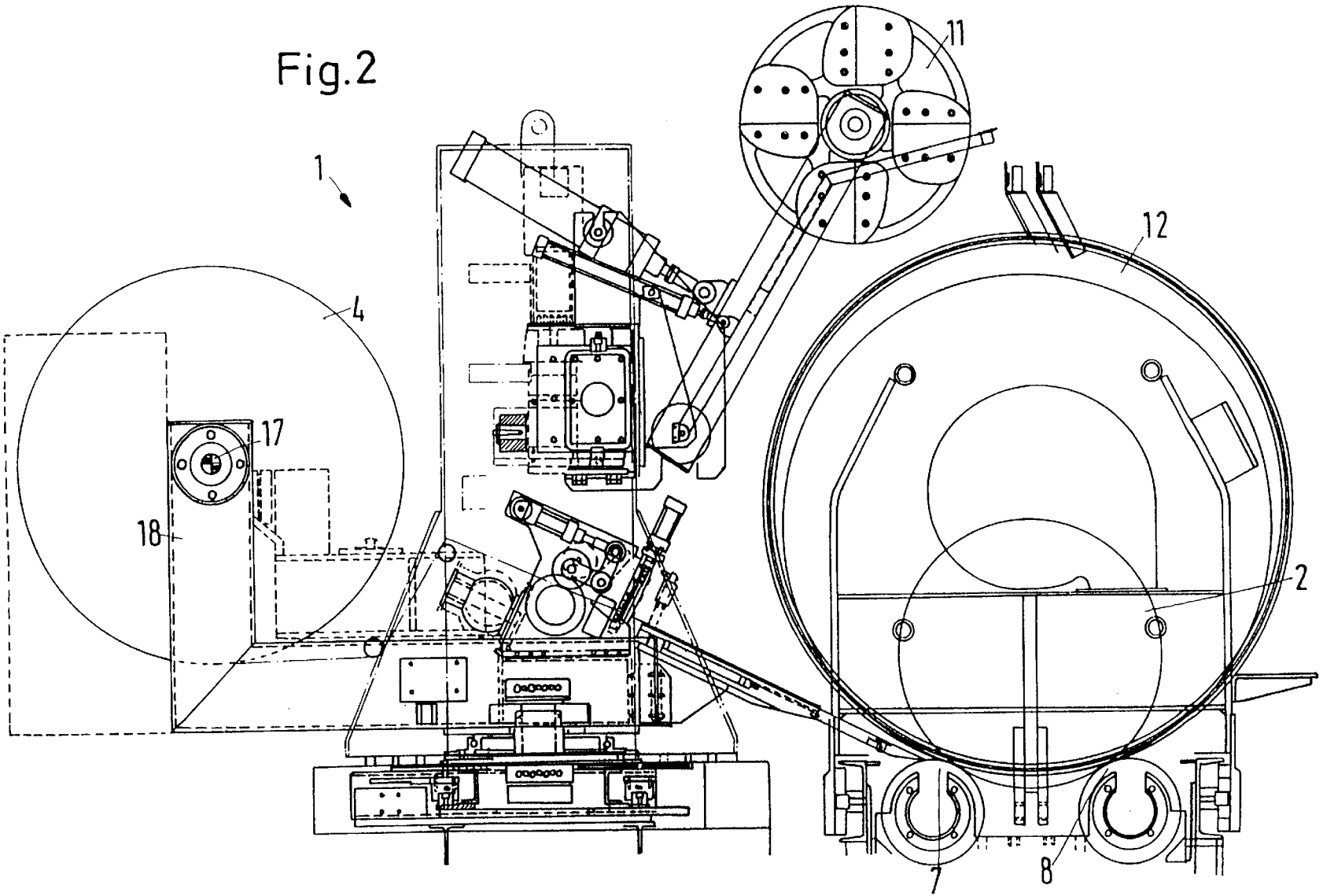
FIG. 2 shows a schematic side view of a packaging device according to one aspect of the present invention.
Figure 3:
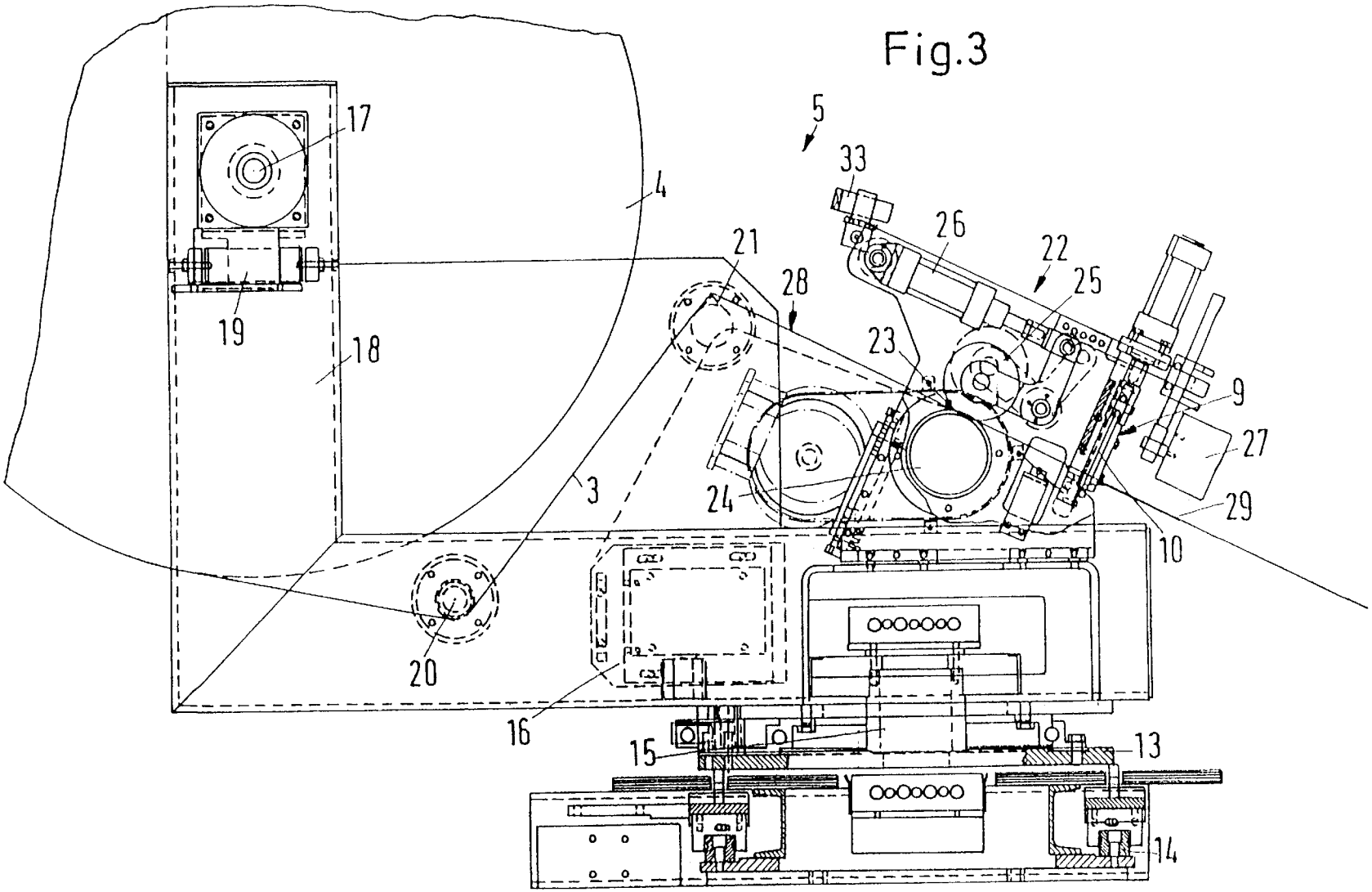
FIG. 3 shows an enlarged section of FIG. 2.

FIGS. 1 and 2 show a packaging device 1 for packaging a web roll 2, for example a large paper roll of approximately 0.8 to 2.5 m. in diameter and approximately 0.8 to 3.8 m. in length. Web roll 2 is wrapped with a packaging sheet 3 made of packing paper having a width of at least approximately 350 mm., preferably approximately 500 mm., which is unwound from a supply roll 4. Supply roll 4 is arranged on a packaging sheet dispenser 5, as shown in FIG. 3. As can be seen in FIG. 1, packaging sheet dispenser 5 can be pivoted or turned from a position illustrated on the left of FIG. 1, in which the lateral direction of the packaging sheet 3 is parallel to the axial direction of the web roll 2, to a position illustrated further to the right of FIG. 1, in which the lateral direction of the packaging sheet 3 forms an acute angle with the axis of the web roll 2. The lateral direction of the packaging sheet 3 is the direction which runs at a 90° angle to the longitudinal extension of the packaging sheet 3. In the present embodiment this coincides with the direction of the axis 6 of the supply roll 4.

Web roll 2 is packaged as follows. First, packaging sheet dispenser 5 is turned at an acute angle to the axis of web roll 2, such that it assumes the position which is shown further to the right in FIG. 1. Packaging sheet 3, with glue applied to its upper side, is threaded into the opening between carrier roll 7 and web roll 2. One of the carrier rolls 7, 8 is motor-driven. When it rotates the web roll, the packaging sheet is wrapped around the web roll in the form of a helical line. Packaging sheet dispenser 5 is moved parallel to the axial direction of web roll 2. When packaging sheet 3 reaches the other end of web roll 2, it is severed.

Packaging sheet dispenser 5 is then aligned such that packaging sheet 3 lies at a right angle to web roll 2, and it creates an axial projection. Packaging sheet 3, with glue applied to its upper side, advances until it is positioned between one of the carrier rolls 7, 8, and web roll 2. When packaging sheet 3 lands in this "opening," it is pulled along. After it has been wound a predetermined number of times, the web is separated with the aid of a separation device 9 which has a severing knife 10.

Packaging sheet dispenser 5 is then moved to the other end of web roll 2 such that it also provides the other end with axially projecting packaging. This projection can be wrapped on the face of web roll 2 with the aid of a folding wheel 11, which is provided for each end face of the web roll 2 (not shown in FIG. 1). Packing presses 12 can then be activated in order to place and secure outer end face covers to the wrapped projections.

It can be seen from this sequence of events that packaging sheet 3 is used in numerous steps during the wrapping process of the web roll. Each step can be viewed as an individual wrapping procedure in which the packaging sheet 3 is accelerated, and then slowed down again, in tandem with the web roll 2. In particular, during the helical wrapping of packaging sheet 3, i.e., during the production of body packaging, it is important to achieve high wrapping speeds as quickly as possible in order to minimize packaging times.

FIG. 3 shows an enlarged illustration of packaging sheet dispenser 5, according to one aspect of the present invention. Packaging sheet dispenser 5 is arranged on sled 13 which can be moved on tracks 14 parallel to the axial direction of web roll 2. On sled 13, a bolt 15 with a large diameter is provided which acts as a pivot for packaging sheet dispenser 5 relative to sled 13. A motor-drive 16, which is illustrated merely schematically, is provided to enable such pivoting.

Supply roll 4 of packaging sheet 3 is positioned on packaging sheet dispenser 5 with its central axis (or axle) 17 on stand 18. Rotational motor-drive 19 has an angle (or elbow) connection with rotational axis 17. Rotational motor-drive 19 can accelerate, as well as brake, supply roll 4.

Packaging sheet 3 runs from supply roll 4 over deflection rolls 20, 21 to packaging feed device 22 which includes a roll opening 23 with a motor-driven roll 24. Packaging sheet 3 is pressed against motor-driven roll 24 with the aid of press roll 25. Piston-cylinder motor 26 is provided for this purpose.

This is followed in the run direction of packaging sheet 3 by separating device 9 with a severing knife 10, and subsequently by a glue relaying device 27, which assists in the application of glue to the upper side 28 of the packaging sheet 3. Glue relaying device 27 includes a glue application device in FIG. 3.

Figure 4:
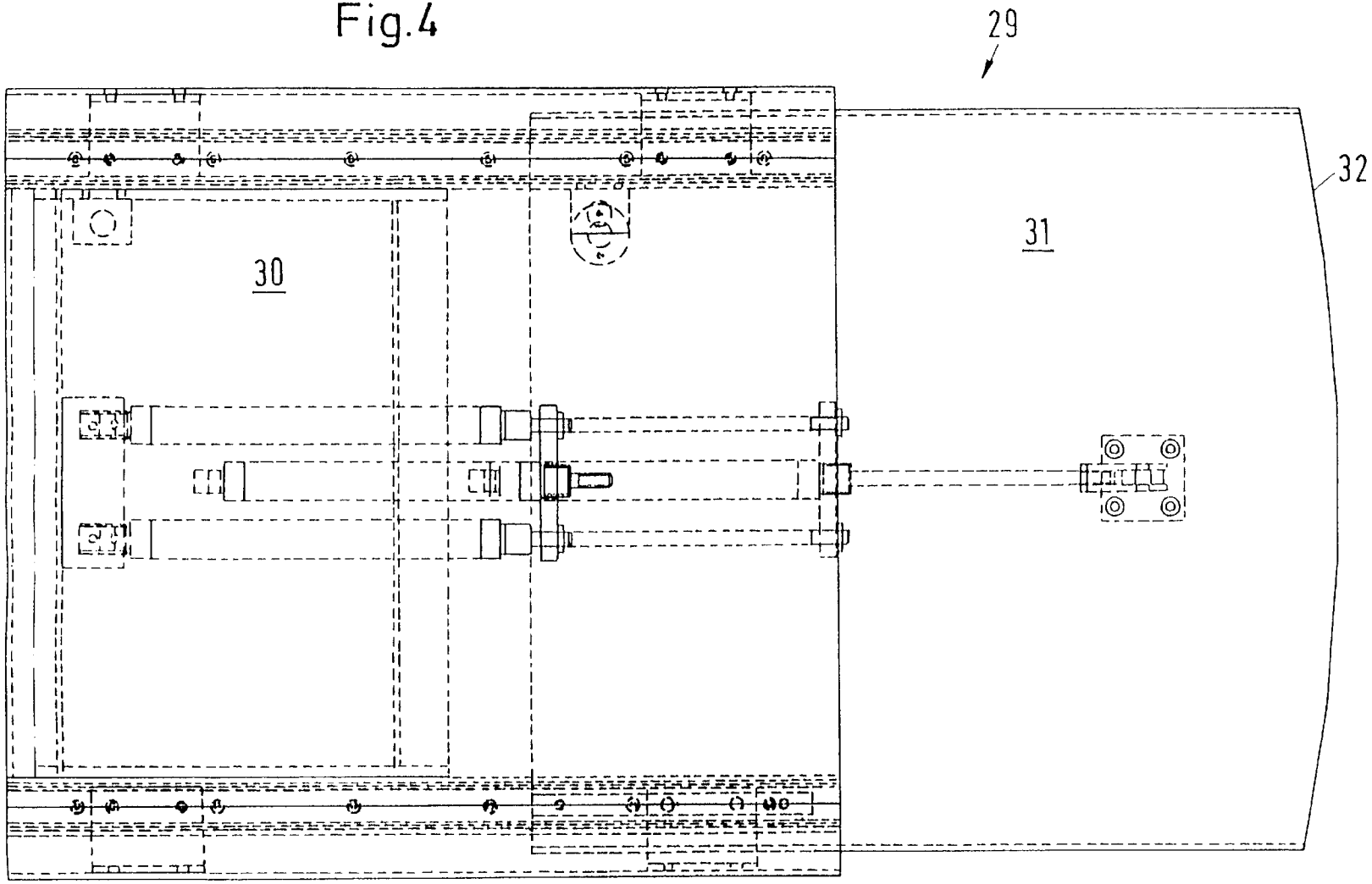
FIG. 4 shows a top view of a guide surface of a packaging device according to one aspect of the present invention.

Packaging feed device 21 further includes a guide surface 29, a top view of which is shown in FIG. 4. The guide surface is hereby designed in two parts. Its rear part 30 is adjacent to packaging feed device 22. Its front part 31 is designed such that it can slide. Thus it can be pushed back or retracted under rear part 30. It can also be pulled out or extended, as shown in FIG. 4. When pulled out, front part 30 is in close proximity to the carrier roll 7, as can be seen in FIG. 2.

The front part 31 includes a rounded-off front end 32. The rounding-off may also be created by a sequence of short straight sections. This aspect of the invention makes it possible for front end 32 to be secured a very short distance from carrier roll 7, independent of the angled position of packaging sheet dispenser 5. This ensures that the packaging sheet, which is advanced over the guide surface 29, always lands in the opening between web roll 2 and carrier roll 7.

Web roll 2 is accelerated on the carrier rolls 7, 8 when the packaging process begins, and supply roll 4 of packaging sheet 3 can also be accelerated with the help of motor-drive 19. Fine-tuning of the speed of packaging sheet 3 with regard to the circumferential speed of web roll 2, such that a certain tension is maintained in packaging sheet 3 during wrapping of the web roll, takes place via packaging feed device 22. Because the moment of inertia of supply roll 4 is almost overcome by rotational motor-drive 19 of supply roll 4, the tensile stress on packaging sheet 3 is kept quite low. Nevertheless, high wrapping speeds, and in particular high acceleration values, can thereby be attained.

At the end of the packaging procedure supply roll 4 is braked with the aid of rotational motor-drive 19 in the same manner as the web roll 2. Practically no excess of the packaging sheet 3, which would have to be taken up, is thereby created.

In addition, packaging sheet dispenser 5 includes a sensor 33 which continuously determines the diameter of supply roll 4. Sensor 33 may operate contact-free by means of a light beam reflection. The smaller the diameter of supply roll 4, the higher its number of rotations must be in order to achieve the same packaging sheet speeds. a control device (not illustrated) is provided which controls the motor-drive of the carrier rolls 7, 8, as well as rotational motor-drive 19 and packaging feed device 22. The control device also coordinates them in such a way that packaging sheet 3 is wrapped around web roll 2 with the necessary tension, which is not, however, so great as to over stress packaging sheet 3.

Since not only motor-driven supply roll 4, but also packaging feed device 22, separating device 9 and glue relaying device 27 are arranged on the sled 13, a very compact construction unit can be realized which allows high wrapping speeds, and thus short wrapping times, to be achieved.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to a functionally equivalent structures, methods and uses, such as are within the scope of the appended claims.

What is claimed:

1. A device for packaging a web roll with a packaging sheet, comprising:

a packaging sheet dispenser that dispenses the packaging sheet at an adjustable angle to a radial direction of the web roll;

a moving device that moves the packaging sheet dispenser parallel to an axial direction of the web roll;

a supply roll of the packaging sheet coupled to the packaging dispenser;

a controllable rotational motor-drive for the supply roll; and a motor-drive that drives the web roll being packaged.

2. A device for packaging a web roll with a packaging sheet in accordance with claim 1, the packaging sheet dispenser comprising a packaging feed device with at least one motor-driven packaging feed roll.

3. A device for packaging a web roll with a packaging sheet in accordance with claim 2, further comprising a separating device arranged between the web roll and the packaging feed device.

4. A device for packaging a web roll with a packaging sheet in accordance with claim 3, further comprising a glue relaying device arranged between the web roll and the separating device.

5. A device for packaging a web roll with a packaging sheet in accordance with claim 1, the rotational motor-drive acting upon the axis of the supply roll.

6. A device for packaging a web roll with a packaging sheet in accordance with claim 5, further comprising a control device which coordinates the circumferential speed of the supply roll to the circumferential speed of the web roll.

7. A device for packaging a web roll with a packaging sheet in accordance with claim 1, the packaging sheet dispenser comprising a guide surface on which the packaging sheet glides to a carrier roll on which the web roll is located.

8. A device for packaging a web roll with a packaging sheet in accordance with claim 7, the guide surface comprising a plurality of parts, at least one guide surface part being adjacent to the carrier roll to be pulled in and out.

9. A device for packaging a web roll with a packaging sheet in accordance with claim 7, the guide surface comprising an end adjacent to the carrier roll that extends at an arching gradient.

10. A device for packaging a web roll with a packaging sheet in accordance with claim 1, the supply roll positioned on the packaging sheet dispenser.

11. A packaging sheet dispenser for packaging a web roll, comprising:

a carriage;

a motor-drive mounted on the carriage;

a mounting bolt pivotally connecting the carriage with a moving device that moves the packaging sheet dispenser parallel to an axial direction of the web roll;

a supply roll;

an angle connection connecting the supply roll and the carriage; and a controllable rotational motor-drive rotatably connected with the supply roll.

12. A packaging sheet dispenser for packaging a web roll in accordance with claim 11, the rotational motor-drive driving an axle of the supply roll.

13. A packaging sheet dispenser for packaging a web roll in accordance with claim 12, further comprising a control device to coordinate the circumferential speeds of the supply roll and the web roll.

14. A packaging sheet dispenser for packaging a web roll in accordance with claim 11, further comprising a packaging feed device with a motor-driven packaging feed roll.

15. A device sheet dispenser for packaging a web roll in accordance with claim 14, further comprising a separating device positioned between the web roll and the packaging feed device.

16. A packaging sheet dispenser for packaging a web roll in accordance with claim 15, further comprising an adhesive application device positioned between the web roll and the separating device.

17. A packaging sheet dispenser for packaging a web roll in accordance with claim 14, further comprising a guide surface on which the packaging sheet glides to a carrier roll of the web roll.

18. A packaging sheet dispenser for packaging a web roll in accordance with claim 17, the guide surface comprising a plurality of parts, at least one guide surface part being adjacent to the carrier roll to be retracted and extended.

19. A packaging sheet dispenser for packaging a web roll in accordance with claim 18, the guide surface comprising an end adjacent to the carrier roll having an arching projection.

20. A method for packaging a web roll with a packaging sheet dispenser that dispenses a packaging sheet at an adjustable angle to the radial direction of the web roll, the packaging sheet dispenser being moveable parallel to the axial direction of the web roll, the packaging sheet dispenser including a packaging sheet supply roll, a controllable rotational motor-drive being rotatably connected to an axle of the supply roll and a web roll motor-drive, the method comprising:

turning the packaging sheet dispenser to form an acute angle with the axis of the web roll aligning the packaging sheet to the circumferential direction of the web roll;

securing the packaging sheet to the web roll;

rotating the web roll;

rotatably driving the packaging sheet supply roll with the controllable rotational motor-drive; and moving the packaging sheet dispenser parallel to the axis of the web roll to helically wrap a portion of the web roll.

21. A method for packaging a web roll in accordance with claim 20, further comprising severing the packaging sheet between the packaging sheet supply roll and the packaged web roll.

22. A method for packaging a web roll in accordance with claim 21, further comprising:

applying adhesive to a face of the packaging sheet.

23. A method for packaging a web roll in accordance with claim 20, further comprising coordinating the circumferential speeds of the supply roll and the web roll with a control device.

24. A method for packaging a web roll in accordance with claim 20, further comprising guiding the packaging sheet to a carrier roll of the web roll on a guide surface.

25. The device for packaging a web roll with a packaging sheet in accordance with claim 1, the controllable rotational motor-drive for the supply roll being coupled to an axle of the supply roll.

26. The method for packaging a web roll in accordance with claim 20, further comprising:

rotatably driving the packaging sheet supply so that a circumferential speed of the packaging sheet supply corresponds with a circumferential speed of the web roll.

* * * * *